United States Patent [19]

Galin

[11] 3,982,621

[45] Sept. 28, 1976

[54] VENDING MACHINE

[75] Inventor: Harry E. Galin, Willow Grove, Pa.

[73] Assignee: Universal Vendors, Inc., Fort Washington, Pa.

[22] Filed: Mar. 13, 1975

[21] Appl. No.: 558,196

[52] U.S. Cl. ..... 194/1 G; 194/57; 194/DIG. 2

[51] Int. Cl.[2] ..... G07F 11/00

[58] Field of Search ..... 194/71, 1 G, 57, 63, 194/68, DIG. 2, DIG. 19, 37

[56] References Cited

UNITED STATES PATENTS

| | | | |
|---|---|---|---|
| 2,330,153 | 9/1943 | Steiner | 194/57 |
| 2,529,196 | 11/1950 | Stoner | 194/57 |
| 2,823,782 | 2/1958 | Ridings et al. | 194/57 |
| 2,858,921 | 11/1958 | Fry | 194/57 |

*Primary Examiner*—Allen N. Knowles
*Attorney, Agent, or Firm*—Caesar, Rivise, Bernstein & Cohen

[57] ABSTRACT

A vending machine adapted to dispense commodities at two different prices while utilizing a single coin slot for the insertion of money. A plurality of plungers are provided, with each plunger adapted to dispense a commodity from an associated column. The commodity can be dispensed at either of the two prices. The unlocking of any plunger is accomplished by direct contact of a feeler mechanism with the inserted coin or coins. Separate feeler mechanisms are provided for each of the two prices. Each of the prices is adjustable in the event that the two prices for vending are to be varied from time to time.

8 Claims, 8 Drawing Figures

VENDING MACHINE

This invention relates to a vending machine, and, more particularly, to a vending machine which is adapted to dispense a variety of differently priced commodities.

A number of vending machines have been developed which are adapted to dispense commodities of varying prices by using a single coin slot. For example, a single vending machine can now dispense commodities priced at 25 and 50 cents by providing locking mechanisms which are responsive to a given amount of money deposited within the vending machine. Thus, a plunger associated with any given column of mechandise will not be operational until at least the preset amount of money required to dispense the item from the column has been deposited in the vending machine, and recorded on a totalizer associated with the coin slot of the vending machine. Devices of this type are shown in U.S. Pats. Nos. 2,993,581, 3,360,091 and 3,578,127.

The presently existing devices adapted to dispense commodities at varying prices with the utilization of only a single coin slot all work well for their intended function. However, these machines are all relatively expensive, since they require a totalizer or accumulator which will record the amount of money inserted. Thereafter, vending takes place through the use of sensing means in contact with means which mechanically indicate the total amount of money deposited in the accumulator. At no time is there any physical contact between the sensing means and the money actually inserted in the device.

The device of this invention is substantially less expensive than the devices disclosed in the aforementioned U.S. Patents. The reason for this is that vending is controlled solely by the contact of sensing means with the coins. The use of an accumulator has been obviated, while still retaining the advantages of the same. Thus, the device of this invention is a two-price vending machine, with the prices being readily adjustable.

Additionally, the vending machine of this invention will dispense commodities based on the amount of any given number of coins of the same denomination that have been deposited in the coin slot. Accordingly, the device of this invention is adapted for use with nickels, dimes, quarters, half dollars or metal dollars, depending on the value of the commodities that are to be dispensed.

It is accordingly an object of this invention to provide a novel vending machine.

It is another object of this invention to provide a coin operated vending machine that is adapted to dispense commodities at either of two preset prices, with the prices being adjustable.

These and other objects of this invention are accomplished by providing a vending machine having a plurality of merchandise columns, a manually operable member for dispensing said merchandise associated with each column, lock means preventing dispensing operation of all of the manually operable members until a predetermined amount of money has been deposited in said vending machine, first sensing means responsive to a first amount of money deposited in the vending machine and second sensing means responsive to a second amount of money deposited in the vending machine, each of said sensing means being adapted to contact said deposited money, each of said sensing means being adapted to open said lock means, whereby one of said operable members can dispense the commodity associated therewith only when a predetermined amount of money has been deposited in said vending machine.

Other objects and many of the attendant advantages of this invention will be readily appreciated as the same becomes better understood by reference to the following detailed description when considered in connection with the accompanying drawings wherein.

Figure 1:
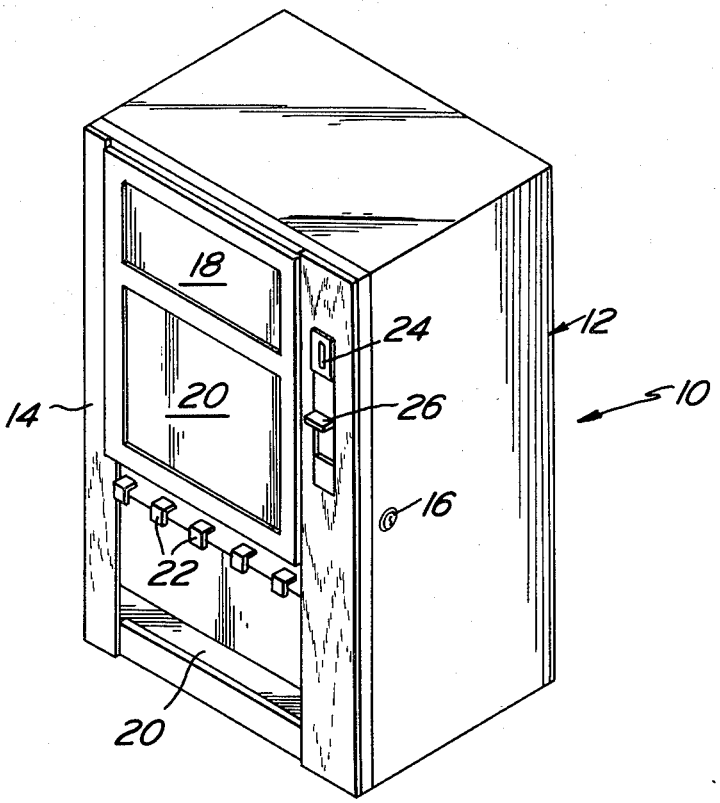
FIG.1 is a perspective view of a vending machine embodying the present invention.
Figure 8:
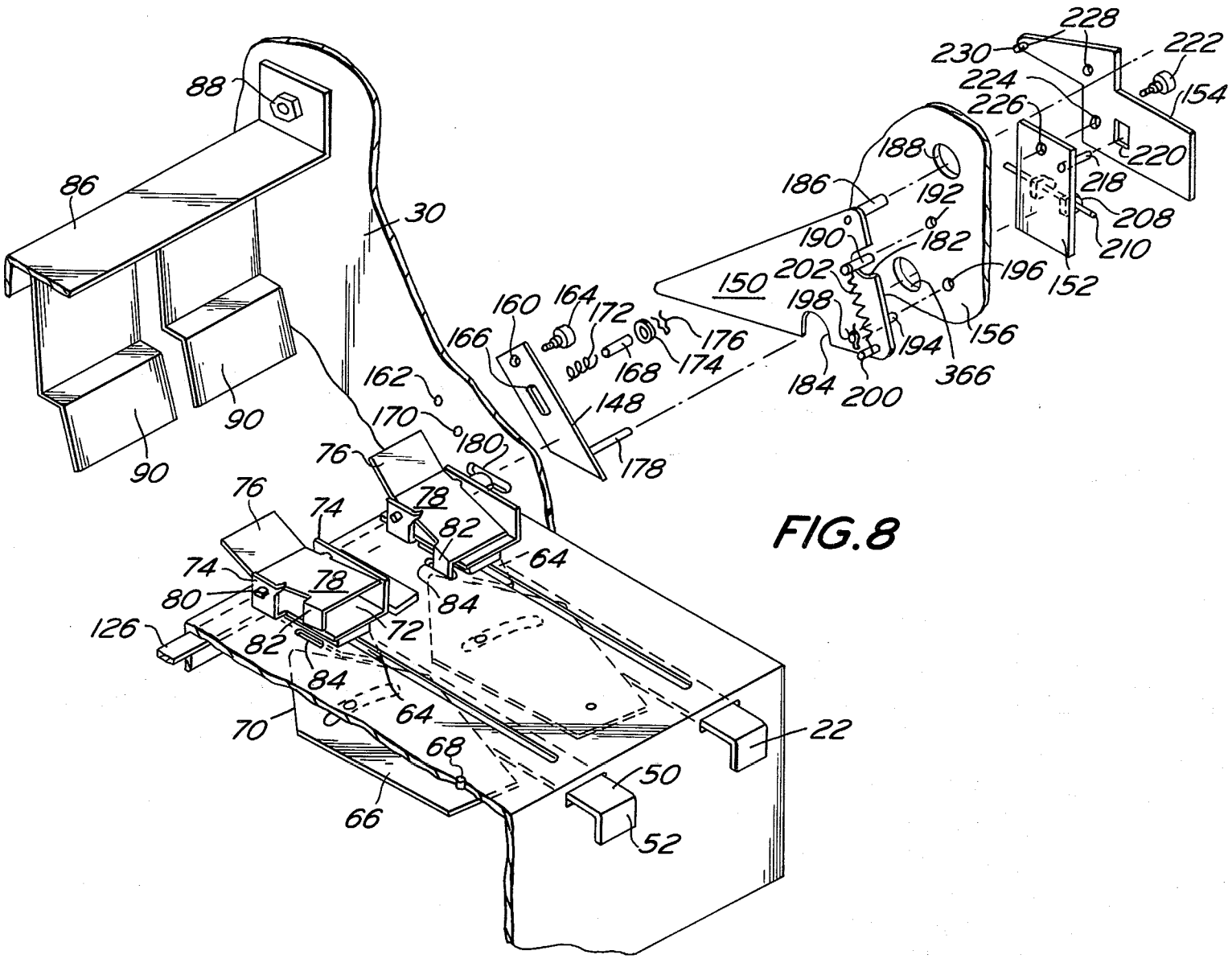

FIG. 8 is an exploded perspective view, partially broken away, of the plunger and coin sensing mechanisms of the vending machine of this invention Referring now in greater detail to the various figures of the drawings wherein like reference characters refer to like parts, a vending machine embodying the present invention is generally shown at 10 in FIG. 1. Device 10 basically comprises a housing 12 having a front door 14 pivotally mounted thereon and a lock 16 securing the front door in place.

Front door 14 includes an advertising window 18 and a second window 20 through which the merchandise to be vended can be seen. A delivery slot 22 is formed at the bottom of the front door. A plurality of plungers through the front door, with each plunger being associated with a different column within housing 12. Front door 14 further includes a coin slot 24 and a coin return lever 26.

Figure 2:
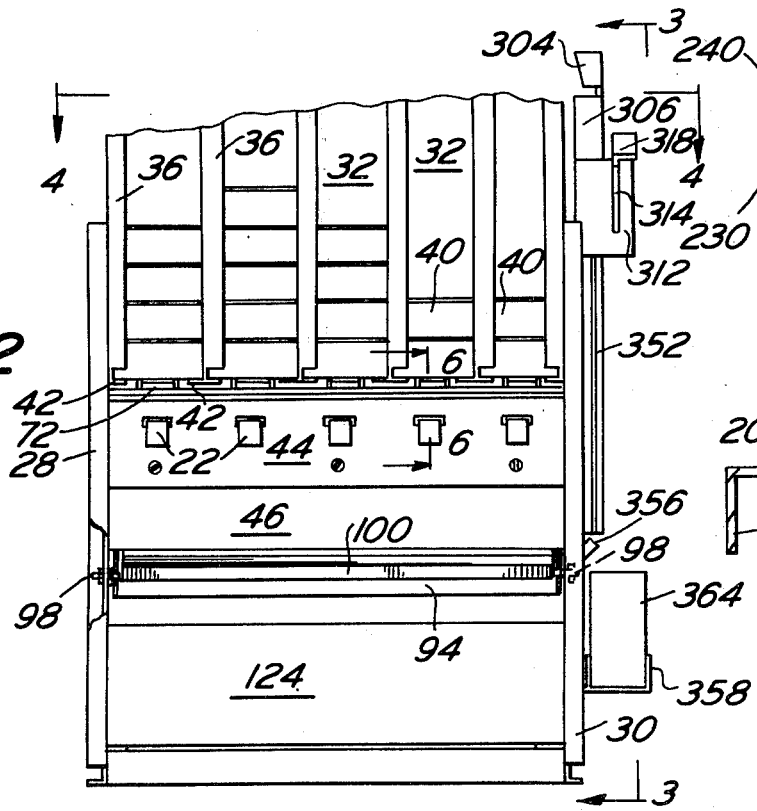
FIG. 2 is a front elevational view of the vending machine of FIG. 1, with the outer cabinet removed.
Figure 3:
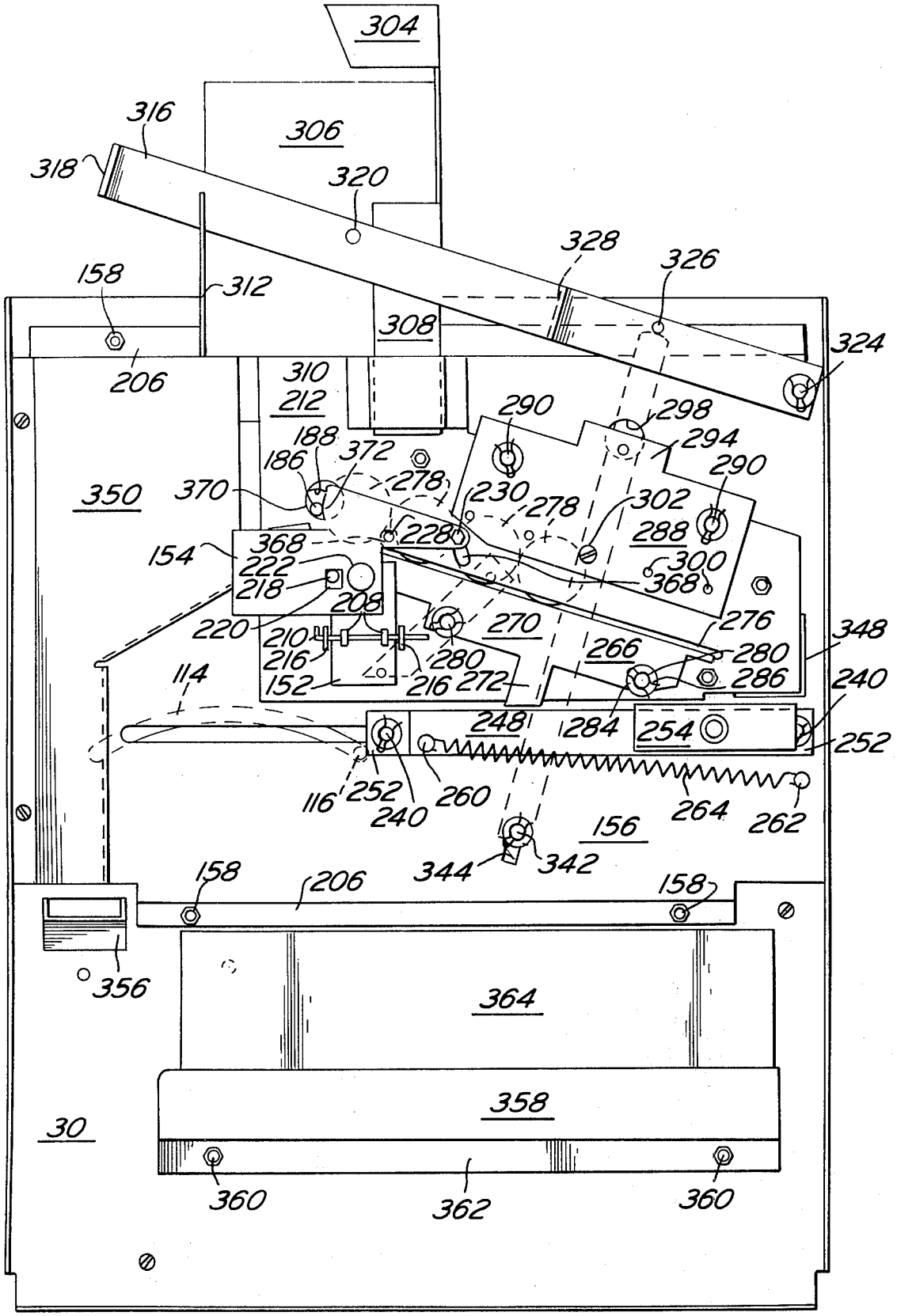
FIG. 3 is an enlarged side elevational view of the vending machine of FIG. 2, and taken in the direction of line 3—3 of FIG. 2.
Figures 4, 6:
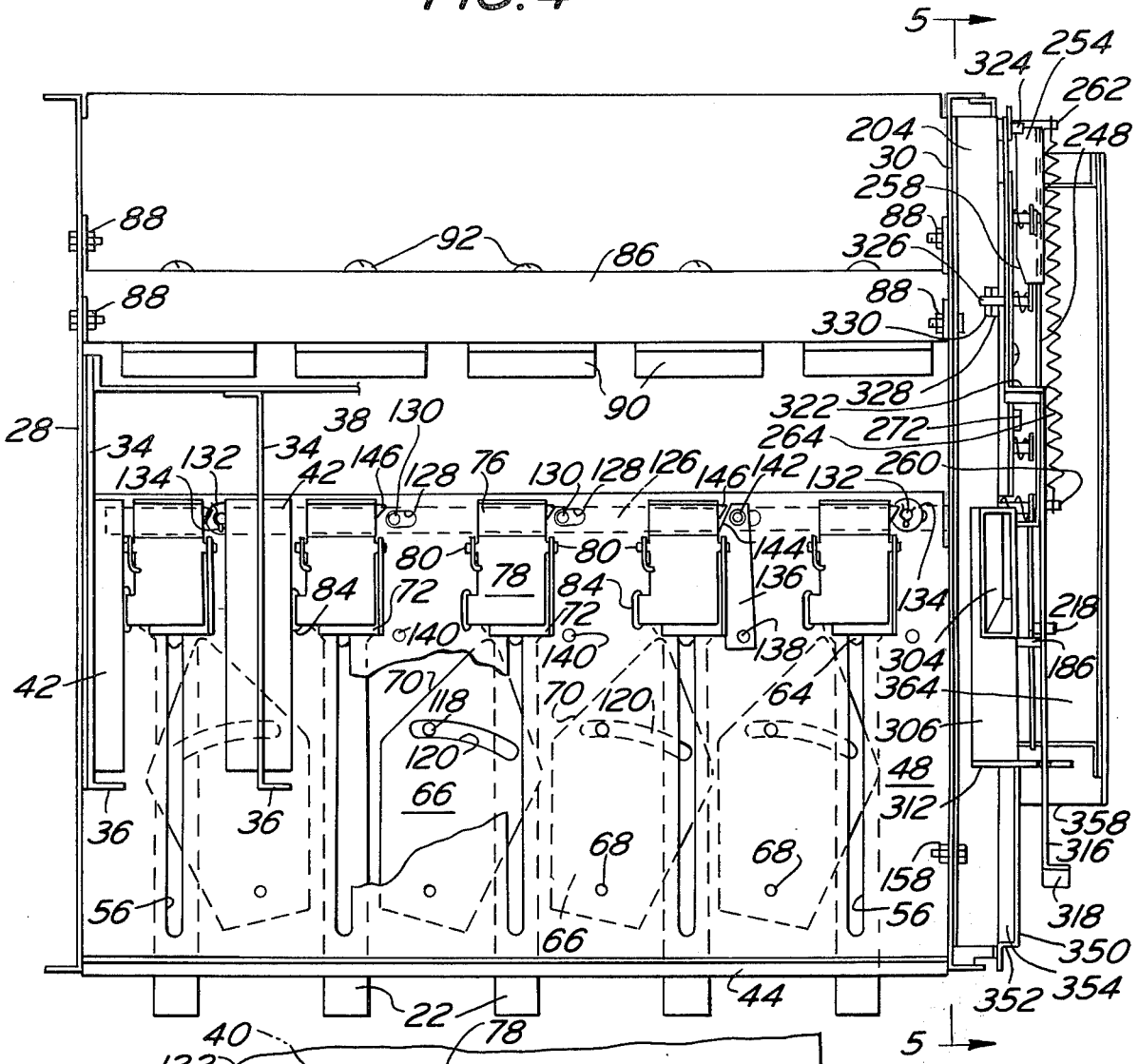
FIG. 4 is a top plan view of the vending machine of FIG. 2, and taken in the direction of line 4—4 of FIG. 2.
FIG. 6 is an enlarged sectional view taken along the line 6—6 of FIG. 2.

Referring to FIGS. 2 to 4, it is seen that the vending machine within the housing 12 comprises a pair of side plates 28 and 30. A plurality of columns 32 for merchandise are positioned between plates 28 and 30. As seen in FIG. 4, each column is formed by a pair of plates 34 having forward flanges 36. The plates 34 are supported by a plate 38 supported between side plates 28 and 30. For the purpose of clarity, plate 38 has been broken off in FIG. 4, as have most of the plates 34. It is to be understood, however, as seen in FIG. 2, that the plates 34 extend across the width of the machine to form the columns 32. Merchandise to be vended is schematically shown in boxes 40 in FIG. 2. These boxes are supported by bottom flanges 42 (FIG. 4) in each of the columns.

As seen in FIGS. 2 and 6, plungers 22 pass through an opening in plate 44 which passes between side plates 28 and 30. Plate 44 is in turn secured to plate 46 on the front of the vending machine. As seen in FIG. 6, plate 46 includes an inwardly projecting flange 48. As further seen in FIG. 6, each plunger 22 comprises a flat bar 50 having a forward, downward flange 52 and a rear downward flange 54.

Flange 48 of front plate 46 includes a longitudinally extending slot 56 associated with each plunger 22 (FIGS. 4 and 6). Flange 48 also includes a rearward flange 58 (FIG. 6).

Each plunger 22 is supported on flange 48 by a pair of rivets 60 which pass through slot 56. A plate 62 is positioned between flange 48 and rod 50, and is also supported by rivets 60. Each plate 62 has a wedge-shaped nose 64 (FIG. 8). A plate 66 (FIGS. 4 and 8) is positioned between each pair of plungers 22. The plates 66 are below flange 48 and are pivotally secured thereto by rivets 68. Each plate 66 has a wedge-shaped nose 70.

A bracket 72 is associated with each plunger 22 and is secured in place by rivets 60 (FIG. 6). As seen in FIG. 8, each bracket 72 includes a pair of spaced upstanding legs 74. A bar having a first section 76 and a second section 78 is pivotally mounted between legs 74 by extending pins 80. As seen in FIG. 6, section 78 projects from bar section 76 at an obtuse angle. A flange 82 projects downwardly from each bar section 78 (FIG. 8). An opening 84 (FIG. 8) is formed in flange 48 beneath each flange 82 (FIG.8).

Whenever there are commodities to be vended in any column 32, the commodities will rest on the upper edges of bar sections 76 and 78. In FIG. 6, a boxed commodity 40 is schematically shown. However, when a given column is empty, bar section 78, since it is larger than section 76, will rotate the bar around pins 80, thereby engaging a flange 82 in an associated opening 84 (FIG. 8). When this occurs, the plunger 22 associated with the bar having its flange in the opening cannot be pulled, since the flange will contact the forward edge of the opening. This insures that no one will be able to attempt to pull a plunger when there is no vendable commodity associated with that plunger. When commodities are later placed in the column, the bar will return to the condition shown in FIG. 6.

An angled bar 86 passes between side plates 28 and 30, and is secured thereto, as by bolts and associated nuts 88 (FIGS. 4 and 8). Leaf springs 90 are secured to the back face of bar 86 by bolts 92 and associated nuts (FIG. 4). A leaf spring 90 is positioned beneath and rearwardly of each column 32.

A plate 94 (FIG. 6) extends transversely across the vending machine of this invention between side plates 28 and 30. Plate 94 includes a pair of end flanges 96 (one shown in FIG. 6).

Plate 94 is rotatably mounted with respect to side plates 28 and 30 by pins 98 passing through flanges 96. A reinforcing bracket 100 extends across the full width of plate 94 and is welded thereto.

A bracket 102 extends across the width of the vending machine, and is secured to plate 94 by screws 104. Bracket 102 includes a leg 106, a perpendicularly extending leg 108 and a leg 110 that extends perpendicularly to leg 108. Leg 106 abuts plate 94 and is secured thereto by screws 104. Leg 110 extends substantially parallel to plate 94, thereby leaving a gap 112. An arcuate slot 114 is formed in wall 30. A pin 116 is secured in flange 96 adjacent wall 30, and projects through slot 114.

To the extent described, the vending machine of this invention is exemplary of the prior art vending machine. Thus, although a specific vending mechanism has been described, it should be understood that the coin mechanism of this invention can be used with all types of mechanical vending machines that utilize plungers for their operation. Before proceeding with the description of the coin mechanism, the operation of the vending machine, as disclosed to this point, will be described.

Referring to FIG. 1, the customer will note the commodity that he desires to purchase and the price for that commodity in window 20. Thereafter, the proper number of coins for the desired commodity are deposited in coin slot 24, and the plunger 22 associated with the commodity is then pulled.

The pulling of a plunger 22 will move the plunger to the right, as viewed in FIG. 6. This in turn will move all of the elements riveted to the plunger through rivets 60 to the right. The plunger will move rectilinearly in view of the engagement of rivets 60 in slot 56 and the engagement of bar 50 of the plunger in the holes in plates 44 and 46.

As the plunger moves to the right, as seen in FIG. 6, the wedge-shaped nose 64 (FIG. 8) of plate 62 will engage the wedge-shaped noses 70 of a pair of plates 66 (FIGS. 4 and 8). This will force the plates apart, on opposite sides of the wedge 64 associated with the plunger that has been pulled. The plates 66 are free to rotate about pins 68, and their path of movement is controlled by pins 118 in slots 120 of each plate (FIG. 4). Continued movement of the plunger will bring the rectangular section of plate 62 between a pair of plates 66 and hold them apart. The purpose of the plates 66 is to prevent the movement of any other plunger when a given plunger is pulled. Thus, the dimensions are such that when a plunger is pulled for full stroke operation, the plate 62 will force plates 66 to block all other slots 56. Accordingly, if it is attempted to pull any other plunger, the nose 64 of the plate 62 associated with that plunger will abut one of the pivotable plates 66. In view of the engagement of a plate 62 between a pair of plates 66, the other plates can no longer move, and accordingly no other plunger can be pulled when a first plunger has been pulled for a full stroke operation.

It should also be understood that if one of the end plungers 22 is pulled, it will push all of the other plates 66 to one sie, thereby preventing the pulling of any other plunger.

Assuming the correct amount of money has been inserted in the vending machine, the plunger 22 that has been pulled can be pulled out for a full stroke operation, thereby permitting vending. When this occurs, the bar formed by sections 76 and 78 (FIG. 6) will be pulled outwardly beyond the forward edge of the commodity box 40. Thereafter, the entire column of commodities will drop downwardly so that the lowermost box will rest on flange 48 of plate 46. At the same time, the bar formed from sections 76 and 78 will rotate in a clockwise direction, as viewed in FIG. 6. This will occur since section 78 is heavier than section 76, and rotation is accomplished around pins 80.

After the bar has rotated in the manner described, the edge 122 of section 76 is raised. Pressure on plunger 22 is released, and the plunger is spring-returned in the opposite direction. When this occurs, the leading edge 122 of bar section 76 will come in contact with the forward edge of a commodity box 40. Continued movement of the plunger will force the commodity box rearwardly and slide it from under the column of commodity boxes 40 (FIG. 2). When the plunger has returned to the position shown in FIG. 6, the commodity box will have been fully removed from under the stack of commodities for delivery.

The removed commodity box is propelled rearwardly by the force of a spring, which will be described hereinafter. The commodity box will then strike the leaf spring 90 (FIG. 8) associated with the column from which the commodity box was removed. The leaf spring 90 will then propel the commodity downwardly and outwardly through a delivery chute 124 (FIG. 2). Thereafter, the commodity is delivered through opening 20 (FIG. 1) in the housing 12.

Referring again to FIG. 6, after a commodity has been dispensed, the other commodities remaining in the column will then slide vertically downward in the column and come to rest on the bar formed by sections 76 and 78. The stack of commodities will then be in the position shown in FIG. 6. It should also be noted that the height of bar section 72 when in its rotated position is less than the height of the boxed commodity. Accordingly, only one commodity will be dispensed on each full stroke of the plunger 22. Referring again to FIG. 8, when the last commodity in a given column has been dispensed, the flange 82 on bar 78 associated with that column will remain in its rotated position, with the section 78 being lowermost. When the commodity is dispensed, the flange 82 will drop into opening 84. Thereafter, it will not be possible to pull the plunger 22 since the flange 82 will engage the edge of opening 84. That column will only be usable after it has been restacked with commodities.

Referring again to FIG. 6, the plate 94 serves the functions of collecting the money that has been deposited, insuring that the correct amount of money has been deposited, and preventing the vending of more than one commodity each time the correct amount of money has been inserted. Thus, when plunger 22 is pulled, the rear flange 54 will engage the upper edge of plate 94. This will in turn rotate the plate 94 about pin 98. During the rotation, the pin 116 will move in arcuate slot 114. If insufficient funds have been deposited, the plate 94 can undergo only a limited arcuate movement. However, if the correct amount of money has been inserted, the full stroke operation of the plunger 22 will rotate the plate 94 in a clockwise direction until the pin 116 reaches the right hand extremity of slot 114. At this point, the commodity 40 will have dropped onto flange 48 of plate 46 and the money will have been collected.

Thereafter, in order to obtain vending, the pull force on plunger 22 is released and the plunger is spring urged back to the position shown in FIG. 6. This causes vending of the commodity, and in addition, will return the plate 94 to the position shown in FIG. 6. In order to insure that the plate is so returned, the flange 54 which is in the gap 112 is forced against the upper edge of leg 110. This will in turn rotate the plate 94 in a counterclockwise direction.

The purpose of the leg 110 is to insure that the plate 94 is returned when the plunger is returned and vending has been accomplished. In this connection, it should be noted that when the plate 94 is in its forwardmost position, the vending machine is unlocked. Accordingly, a purchaser would be in the position to rapidly return the plunger 22 to complete vending and pull it forward again so that a new commodity is ready for vending unless the plate is returned. By providing the bracket 102, whenever the plunger is returned it will automatically return the plate to the position shown in FIG. 6, thereby resetting the machine.

The commodity dispensing portion of the vending machine described above has been shown solely for the purpose of example. It should be understood that the price control mechanism of this invention can be used with any of the commodity dispensing vending machines known to the art. The novelty of the invention resides in the mechanism for controlling vending at two different prices through the use of sensing means coming into contact with the deposited coins. The control mechanism for the lower price will now be described.

Referring to FIGS. 6 and 8, it is seen that a bar 126 is positioned beneath flange 48 of plate 46, and adjacent flange 58. Referring to FIG. 4, it is seen that there is an opening 128 in flange 48 adjacent each bracket 72. A pin 132 is secured on the top of bar 126, and projects through each opening 128. Each pin 130 has an internally threaded hole formed therein. Bar 126 is supported against the underside of flange 48 by a pair of washers 132 and cotter pins 134 secured in the upper side of pins 130, and above flange 48. Additionally, the bar 126 is slidable relative to flange 48 to the extent limited by the engagement of pins 130 in openings 128.

The bar 126 is used solely with vending commodities at the lower price. Whenever it is desired to vend a commodity in a given column at a lower price, an auxiliary bar 136 (FIG. 4) is used. Auxiliary bar 136 is placed on top of flange 48, and adjacent the bottom plate of bracket 72 (FIG. 6). The axuiliary bar is pivotally mounted on flange 48 by a screw 138. As seen in FIG. 4, an internally threaded opening 140 is positioned adjacent each bracket 72, and the screw 138 is threadedly secured in an opening 140. Bar 136 is also placed over a pin 130, and is secured in place by a screw 142 which is received in the threaded opening within the pin. The rear end of bar 136 has an angled face 144 (FIG. 4). Additionally, the base plate of each bracket 72 has an angular projection 146 at the rear thereof. As seen in FIG. 4, the angle of projection 146 is complementary with the angle 144.

A bar 136 can selectively be placed adjacent any plunger 22 that is to be used with dispensing lower price commodities. Since there is a threaded opening 140 and a pin 130 associated with each plunger, it is a simple matter to place a bar 136 adjacent any desired plunger. When a plunger associated with a bar 136 is pulled, the angular projection 146 of bracket base plate 72 will abut the angled face 144 of the plate 136. Continued forward movement of the plunger, and its associated bracket, will cam the bar 136 to the right, and around pin 138. This in turn will move the bar 126 to the right, as viewed in FIG. 4, through the force applied to the pin 130 associated with the bar 136.

The control mechanism for lower-price vending is best seen in FIG. 8. As seen therein, the mechanism includes a plate 148, a lock plate 150, a pivot plate 152 and a coin sensing plate 154. Plates 150, 152 and 154 are all supported on a wall 156 which lies parallel to wall 30 and is secured thereto by bolts and associated nuts 88 (FIG. 4) and by other spaced bolts and associated nuts 158 (FIG. 3).

Referring again to FIG. 8, it is seen that plate 148 includes an upper opening 160 that is alignable with an opening 162 in wall 30. Plate 148 is loosely secured relative to wall 30 by a shoulder pin 164 which passes through hole 160 and is received in hole 162. Plate 148 also includes a downwardly inclined elongated slot 166. A pin 168 passes through slot 166 and is secured in opening 170 and wall 30. A compression spring 172 is telescoped over pin 168, and is held in compression by a washer 174 and a cotter pin 176 that is secured in pin 168. A rod 178 is secured in plate 148 and projects outwardly from the plate in a direction away from wall 30. Wall 30 includes an elongated slot 180 through which price bar 126 is adapted to pass. When the bar passes through slot 180, it will contact plate 148.

Lock plate 150 is basically triangular in shape, and includes arcuate openings 182 and 184 in two of the legs thereof. A pin 186 is secured in plate 150 and passes through an opening 188 in wall 156. A pin 190 is secured in opening 192 of wall 156, and is received in opening 182 of plate 150. A pin 194 is received in opening 196 of wall 156. Plate 150 is pivotally mounted on pin 194, and is secured thereon by cotter pin 198.

A pin 200 is secured in plate 150 and projects perpendicularly therefrom. A tension spring 202 connects pin 200 with pin 190. The tension spring rotates plate 150 in a counter-clockwise direction, as viewed in FIG. 8, around pin 194.

Figure 7:
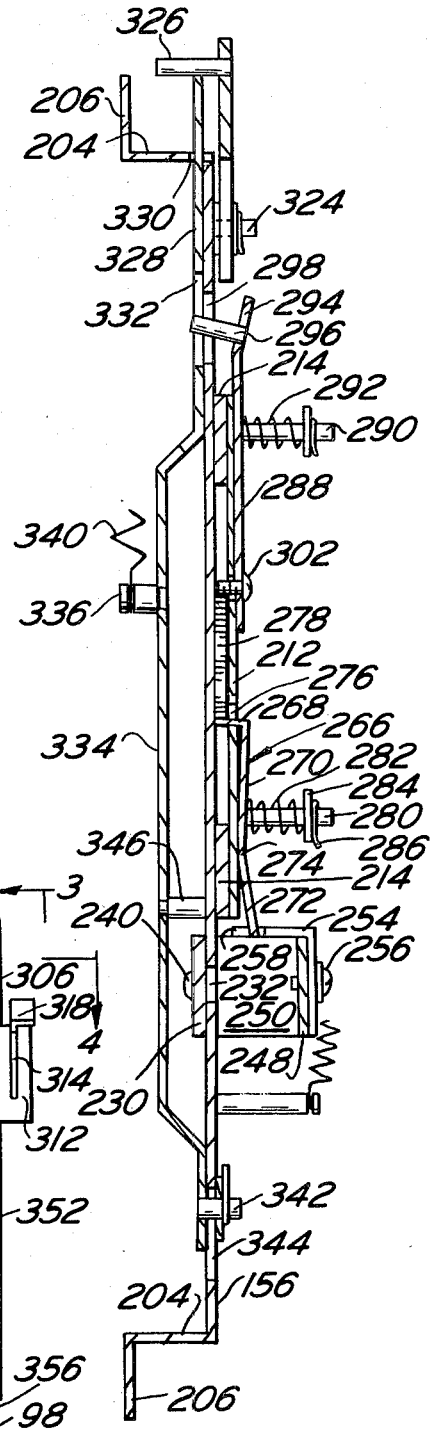
FIG. 7 is an enlarged sectional view taken along the line 7—7 of FIG. 5.

Plate 156 lies parallel to plate 30, and is outwardly spaced therefrom by top and bottom flanges 204 (FIG. 7). The plate 156 is secured to plate 30 by vertically extending flanges 206 (FIGS. 3 and 7). In this way, plates 148 and 150 can be positioned between plates 30 and 156.

Referring to FIG. 8, it is seen that pivot plate 152 is basically rectangular in shape. A pair of spaced tabs 208 are secured to one face of plate 152, and are rotatable about shaft 210. A coin retaining plate 212 (FIGS. 3 and 7) is secured on wall 156 by spaced bars 214 (FIG. 7). A pair of tabs 216 (FIG. 3) are secured on plate 212 and project outwardly therefrom. Shaft 210 is secured in tabs 216, and plate 152 is pivotable about shaft 210. A pin 218 is secured in plate 152 and projects perpendicularly therefrom. Pin 218 passes through enlarged opening 220 in coin sensing plate 154. Plate 154 is secured to plate 152 by shoulder pin 222 that passes through opening 224 in plate 154 and is secured in opening 226 in plate 152. Additionally, plate 154 is rotatable about pin 222. A pair of spaced openings 228 are formed in plate 154. Each of these openings is internally threaded. A bolt 230 is threadedly secured in one of the openings 228.

Figure 5:
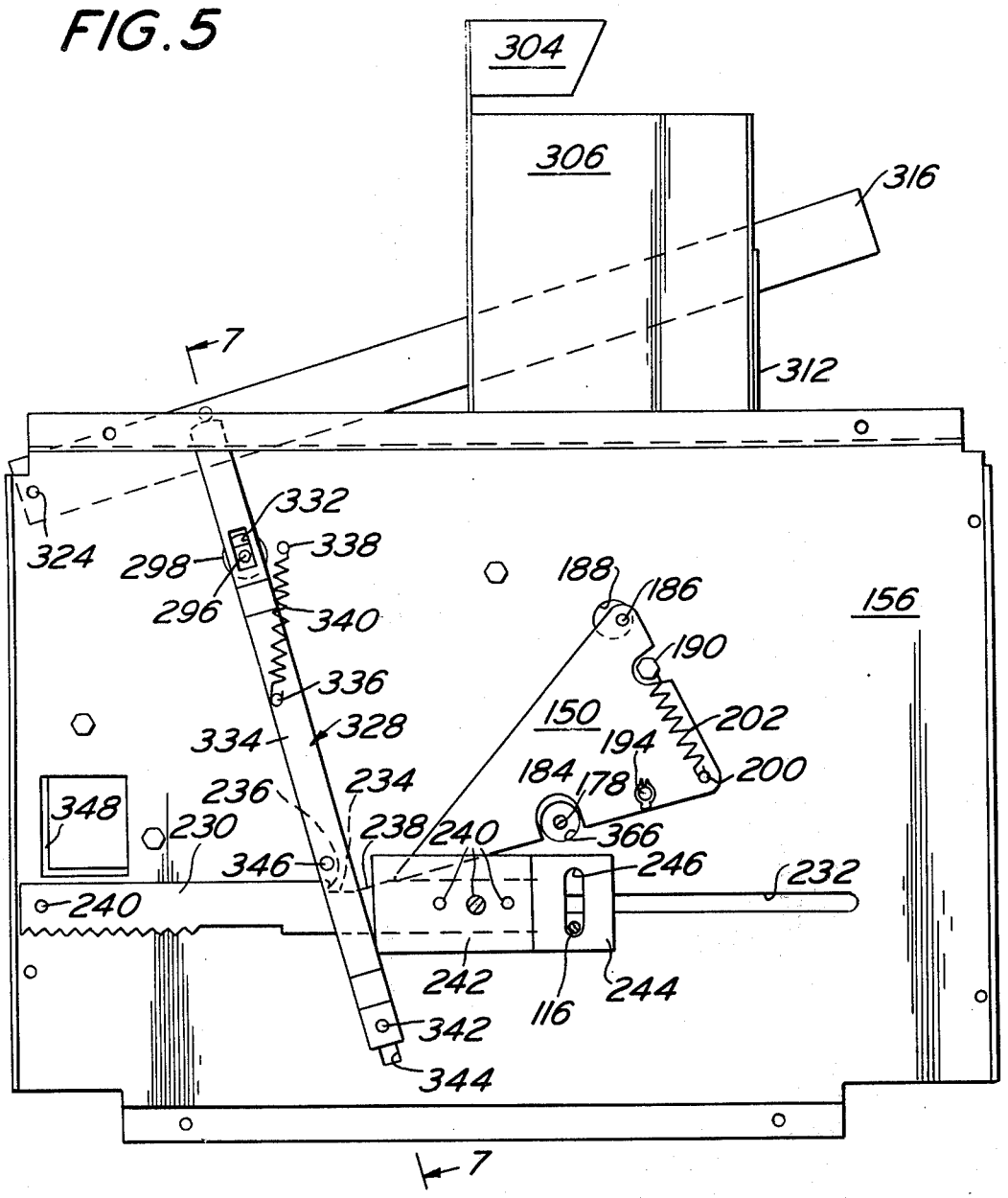
FIG. 5 is a sectional view taken along the line 5—5 of FIG. 4.

A lock bar 230 (FIG. 5) is slidably mounted against wall 156, and is positioned between walls 30 and 56. Wall 156 includes a longitudinal slot 232 formed therein. Bar 230 includes a notch 234 in its upper surface, which notch has a rear shoulder 236 and an inclined front wall 238. A plurality of pins 240 pass through slot 232, and secure bar 230 against the wall 156. A plate 242 is secured against bar 230 by some of the pins 240. Plate 242 includes an outwardly projecting flange and a flange 244 projecting perpendicularly to the outwardly projecting flange. Thus, flange 244 lies parallel to plate 242 and is spaced from wall 156. As seen in FIG. 5, pin 116 (FIG. 6) is received in a vertically extending slot 246 in flange 244.

A bar 248 is mounted on wall 156 on the side opposite lock bar 230 (FIGS. 3 and 7). Bar 248 lies parallel to wall 156 and is spaced therefrom by flanges 250 (one shown in FIG. 7). Flanges 250 in turn have flanges 252 (FIG. 3) which are secured against wall 156 by bolts or pins 240 (See also FIG. 5). An angle bracket 254 is secured to bar 248 by bolt 256. As seen in FIGS. 4 and 7, the leading edge of the top leg of angle bracket 254 is angled, as shown at 258. A pin 260 is secured in bar 248 and a second pin 262 is secured in wall 156. A tension spring 264 connects pins 260 and 262, thereby drawing bar 248 and its associated bar 230 toward the rear of the machine.

A coin supporting bracket 266 (FIG. 7) is mounted on coin retaining plate 212. Bracket 266 includes an upper leg 268, a leg 270 substantially vertically depending therefrom and a leg 272 depending from leg 270 and projecting outwardly therefrom. A fulcrum 274 is formed between legs 270 and 272. As seen in FIGS. 3 and 7, leg 268 passes through slot 276 in coin retaining plate 212. As seen in FIG. 3, leg 268 and slot 276 are downwardly inclined in going from the front to the rear of the vending machine. As will be explained hereinafter, leg 268 provides a ramp for deposited coins, which are shown at 278 in FIG. 3.

A pair of pins 280 pass through openings in leg 270, and are secured in coin retaining wall 212 (FIGS. 3 and 7). A compression spring 282 is telescoped over each pin 280 and held in place by washers 284 and cotter pins 286. The force of springs 282 pivots the bracket 266 counterclockwise around fulcrum 274, as seen in FIG. 7, and maintains upper leg 268 in contact with wall 156. In this way, the coins 278 are supported on the upper leg 268.

A price adjustment plate 288 (FIG. 3) is supported on coin retaining plate 212 by a pair of spaced pins 290. A compression spring 292 (FIG. 7) is telescoped over each pin 290 and held in place by washers and associated cotter pins. Plate 288 includes an upwardly inclined flange 294 (FIGS. 3 and 7). A pin 296 (FIG. 7) projects from flange 294, and through an opening 298 in wall 156. Five equally spaced threaded openings 300 (FIG. 3) are formed in plate 288. A bolt 302 is selectively threaded through one of the openings 300. As seen in FIG. 7, bolt 302 also passes through coin retaining plate 212, and as seen in FIG. 3, serves as a stop for the coins 278 which roll down the ramp formed by leg 268.

As seen in FIGS. 3, 4 and 5, a coin hopper is supported on wall 156. The coin hopper will receive coins that have been deposited in coin slot 24 (FIG. 1). Positioned below the coin hopper is a slug rejector 306. The coin hopper and slug rejector are held in place by a bar 308 (FIG. 3) that is slidably received in a U-shaped bracket 310 secured on wall 212. The bar 308 is secured to slug rejector 306.

A plate 312 (FIGS. 3, 4 and 5) is secured on slug rejector 306. As seen in FIG. 2, plate 312 has a vertically extending slot 314 extending downwardly from the top thereof. A coin-return bar 316 (FIG. 3) is received in slot 314. Bar 316 has a flange 318 (FIG. 4) at the end thereof. An opening 320 is formed in bar 316, and a linkage (not shown) connects bar 316, through opening 320, with the interior mechanism of slug rejector 306. An offset 322 (FIG. 4) is formed in bar 316. Bar 316 is rotatably mounted on wall 156 by pin 324 (FIG. 3) and an associated washer and cotter pin. A pin 326 (FIGS. 3 and 4) is secured in bar 316, and overlies upper flange 204 of wall 156.

Referring to FIG. 5, it is seen that an inclined bar 328 is mounted on wall 156 on the side opposite coin return bar 316. The upper end of bar 328 passes through an opening 330 (FIG. 4) in upper flange 204. Pin 326 (FIGS. 4 and 7) rests on the top of bar 328. Referring to FIGS. 5 and 7, it is seen that bar 328 includes an opening 332 through which pin 296 projects. Bar 328 includes a position 334 which is offset from wall 156. A pin 336 is secured to offset portion 334, and a pin 338 (FIG. 5) is secured on wall 156. A tension spring 340 is connected to pins 336 and 338.

A pin 342 projects from bar 328 through an angled slot 344 in wall 156. As seen in FIG. 7, the pin is secured in place by a washer and associated cotter pin. A pin 346 is secured to offset portion 334 of bar 328, and overlies lock bar 230 (FIG. 5). A coin return chute 348 (FIG. 5) is formed in wall 156, and is positioned at the bottom of the ramp formed by leg 268 of coin supporting bracket 266 (FIG. 3).

A plate 350 (FIG. 3) is secured on plate 156, and is spaced therefrom by flange 352 (FIG. 4). As seen in FIG. 4 plate 350 forms a chute 354. Returning to FIG. 3, it is seen that the chute 354 formed by plate 350 is positioned below slug rejector 306. Any slugs that are rejected pass from rejector 306, down through chute 350 to chute 356 (FIG. 2). The rejected slugs are then deposited on delivery chute 124 (FIG. 2) where they are returned to the customer through opening 20 in housing 12.

A U-shaped bracket 358 (FIG. 2) is positioned below wall 156 (FIG. 3). The bracket is mounted on wall 30 by bolts 360 passing through flange 362 (FIG. 3). A coin box 364, which is open at its top, is supported in bracket 358, and is removable therefrom by sliding it out of the bracket.

The operation of the vending machine of this invention will now be described. As pointed out above, the vending machine is adapted to vend commodities at either of two different prices. Since the control of the vending machine is dependent upon contact of sensing means with the deposited coins, one requirement of the machine is that all of the deposited coins be of the same denomination. In the embodiment of the invention shown, all deposited coins are quarters. However, it should be understood that the invention will work equally well with coins of other denominations, such as nickels, dimes, half dollars and metallic dollars.

Referring to FIG. 3, the price setting mechanisms are shown therein. More particularly, the adjustment for the lower price commodity is made through the use of holes 300 in plate 288 and the selective insertion of screw 302 in one of these holes. The price differential for the higher priced commodity is made through holes 228 in plate 154 and the selective insertion of screw or bolt 230 in one of the holes 228. In the embodiment shown, the price differential between the lower priced commodity and the higher priced commodity can be set at either 25 cents or 50 cents. Again by way of example, in the embodiment shown, the placing of bolt 302 in the hole shown in FIG. 3 and the placing of bolt 230 in the hole shown in FIG. 3 permits the vending of commodities at either 50 cents or $1.00.

The sequence of operations for the vending of a 50 cents commodity will now be described. Referring to FIG. 1, the customer will note the commodity that he desires to purchase in window 20 and note the price of the same. Assuming the price for that commodity is 50 cents, the customer will then deposit two quarters in coin slot 24. Referring again to FIG. 3, the quarters will pass into coin hopper 304 and then to coin separator and slug rejector 306. The coin separator and slug rejector 306 is well known to the art, and any of the devices of this type can be used in this invention. The quarters will then leave the coin separator and slug rejector 306 and pass downwardly between walls 156 and 212 (see coin 278 in FIG. 7). The two deposited quarters will then roll down the ramp provided by the upper leg 268 of bracket 266, and will be stopped by the bolt 302, as seen in FIG. 3.

After the 50 cents in quarters has been deposited, the plunger associated with the commodities sought to be purchased is pulled. Referring to FIG. 4, the second plunger from the right is the only one adapted to vend a commodity at the lower price, which in this example, is 50 cents. Thus, a lower priced commodity can only be vended when a bar 136 has been placed in association with the plunger. Pulling the plunger 22 shown in FIG. 4 will bring the angled tab 146 associated with that plunger into contact with the angled face 144 of bar 136. As the plunger is pulled forwardly, the contacting of the two angled faces will shift the bar 136 in a clockwise direction, as seen in FIG. 4. This in turn will shift the price bar 126 to the right, as viewed in FIG. 4.

Referring now to FIG. 8, it is seen that when the bar 126 is shifted to the right it will pivot the lower end of bar 148 to the right, against the force of spring 172. The movement of the bar 148 to the right will in turn move the pin 178 to the right. The pin passes through slot 184 in plate 150 and opening 366 (FIGS. 5 and 8) of wall 156. The pin 178 will then contact the bottom of plate 152, and rotate the plate about shaft 210. Since the plate 154 is secured to plate 152 by shoulder bolt or pin 222, and the securement is above the pivot point formed by shaft 210, the plate 154 will rotate in a counter-clockwise direction, as viewed in FIG. 8.

The rotation of the plate 154 in a counter-clockwise direction will bring screw 230 on plate 154 into arcuate slot 368 (FIG. 3) in coin retaining wall 212. A similar slot 368 is formed in wall 212 behind threaded opening 228 in plate 154. This rotation of the plate 154 brings the bolt 230 behind the rear quarter 278 which is on the ramp formed by coin supporting bracket 266.

As explained above, when any plunger 22 is pulled, dependent flange 54 (FIG. 6) will engage the top edge of plate 94. Continued pulling of the plunger will rotate the plate 94 about pin 98. As the plate 94 is rotated in a clockwise direction, as viewed in FIG. 6, the pin 116 will also move forwardly in the arcuate slot 114. As the pin moves forwardly, it will pull lock bar 230 (FIG. 5) forwardly. In this connection, the vertical movement of the pin 130 in slot 114 is accommodated by the vertical slot 246 in flange 244 which is secured to the bar 230 via plate 242 and associated rivets 240.

Referring to FIG. 5, as the lock bar 240 moves forwardly, the nose of plate 150 would normally be urged into recess 234 in the lock bar, because of the counter-clockwise rotational force placed on plate 150 by spring 202. Thus, the plate 150 is normally free to rotate about pin 194.

If insufficient money were placed in the vending machine, the nose of plate 150 would be forced into recess 234 and abut shoulder 236 in bar 230. When this occurred, the plunger 22 could no longer be pulled, and vending could not take place. However, since the 50 cents required for the given plunger has been deposited, vending will take place. This is accomplished by the engagement of bolt 230 (FIG. 3) with the back edge of the second quarter 278. Thus, the engagement of the bolt 230 with the rear edge of coin 278 prevents plate 154 from rotating any further than it has rotated in FIG. 3. Returning to FIG. 5, it is seen that pin 186 on plate 150 passes through opening 188 in wall 156. Referring to FIG. 3, it is also seen that pin 186 passes through aligned opening 370 in wall 212. Referring to FIG. 5, when plate 150 is rotated in a counter-clockwise direction, pin 186 will likewise be so rotated, and pass through the aligned openings 188 and 370. If the two quarters 278 have been deposited in the vending machine, the clockwise rotation of plate 154 (FIG. 3) is halted by the abutment of bolt 230 against the rear edge of the second quarter 278. At the same time, the pin 186 will abut the upper rear edge 372 of plate 154. This will prevent any further rotation movement of the plate 150.

Returning to FIG. 5, it is seen that when the pin 186 contacts the edge 372 of plate 154, rotational movement of the plate 150 is prevented. Accordingly, the lower end of plate 150 will not be able to enter the notch 234, and the lock bar 230 will pass under the plate 50. When the lock bar is permitted to pass to the forward end of slot 232, vending can take place in the manner described above. Thereafter, the plunger 22 will be returned to the position shown in FIG. 6, and the spring 264 (FIG. 3) will return the lock bar to the position shown in FIG. 5.

Returning to FIG. 3, a description of what will occur in the event that less than two quarters have been placed in the vending machine, and the plunger 22 has been set to vend at 50 cents follows. In this case, when the pin 186 is brought in contact with the rear edge 372 of plate 154, the bolt 230 will again sense the presence or absence of a second quarter 278. If the second quarter 278 is not present, then when the pin 186 is brought to bear against the rear edge of plate 154 it will rotate the plate in a clockwise direction about bolt 222. However, since there is no quarter 278 upon which bolt 230 will bear, the pressure of pin 186 will cause plate 154 to continue to rotate until the bolt 230 reaches the bottom of slot 368. Since there is no force preventing the rotation of plate 150, as viewed in FIG. 5, the plate will enter the notch 234 when the rod 230 is moved to the right. In this case, vending will not take place. In order to obtain vending, the two quarters 278 will have to be deposited in the vending machine so that rotation of plate 154 is prevented.

In the embodiment of the invention illustrated in FIG. 3, lower price vending has been described in connection with two deposited quarters. By the appropriate moving of screw 302, the lower priced vending can vary from 25 cents to $1.00 in increments of 25 cents. It should also be understood that by enlarging the machine, greater sums can be adopted. Furthermore, by the appropriate spacing of the holes 300, the device of this invention can be adapted for accepting other denominations of coins, providing all coins are of the same size.

Referring to FIG. 3, the plate 154 is used for determining the difference in price between the lower priced items and the higher priced items. Thus, if screw 230 is in the forward hole 228, the difference in price will be 50 cents, as indicated by the two quarters shown in FIG. 3. However, if the screw 230 is in the left hole 228, the difference in price between the two commodities will be 25 cents. Thus, if the screw 230 is in the left hole 228, the control for the lower priced items is at the position of the left hand screw.

The vending at the higher price will now be described. Assuming the vending machine has been set to vend higher priced commodities at $1.00, then four quarters will have to be deposited in the vending machine in the manner described above. The plunger 22 associated with the higher priced commodity is then pulled. However, where a higher priced items is to be vended, no bar 136 (FIG. 4) is used. In this connection, it should be recalled that the bars 136 are readily insertable and removable merely by removing the screws 138 and 142. When a plunger that is not associated with a bar 136 is pulled, there will be no movement of the lower priced bar 126. Accordingly, the lower price plates, as illustrated in FIG. 8, will not be engaged, and will form no part of the vending.

However, when a higher priced plunger is pulled, the plate 94 (FIG. 6) is again rotated, thereby bringing pin 116 along with it. The pin will in turn rotate plate 150 (FIG. 5) in the manner described above. If less than $1.00 has been inserted in the vending machine, the nose of plate 150 will again engage notch 234, thereby preventing any further movement of the bar 230, and thus preventing vending.

However, assuming the $1.00 in quarters has been inserted, the rotation of plate 150 will bring the pin 186 in contact with the rear edge of the uppermost quarter 278 (FIG. 3). This will prevent rotation of the plate 150, thereby permitting the bar 230 to go through a full reciprocation, thereby permitting vending. It should also be noted that since the bar 126 is not engaged when the higher priced plunger 22 is pulled, the plate 154 will not be rotated against wall 212. Thus, the pin 186 will not contact the rear edge 372 of plate 54 when it seeks to feel the uppermost quarter 278. Instead, the pin 186 will pass behind plate 154, as viewed in FIG. 3.

Still referring to FIG. 3, the reason why vending cannot take place if insufficient funds are deposited and the higher-priced plunger is pulled is apparent. Thus, if the uppermost quarter 278 is not present, and the plate 150 is rotated by the pulling of the plunger, the pin 186 will move forwardly to the full extent of openings 188 and 370. When this occurs, the edge of plate 150 will be engaged in notch 234 (FIG. 5), thereby preventing vending. As explained above, if the uppermost quarter is present, the edge of plate 150 will overlie the notch 234, thereby permitting vending.

Assuming it is desired to vend commodities at either 25 or 50 cents, the screw 302 should be inserted in the left hole 300. The screw 230 should be inserted in the left hole 228. In this way, the lower prices items will be vended at 25 cents and the higher priced items will be vended at 50 cents.

At the time the bar 230 goes through its full reciprocation to permit vending, the money on the coin supporting bracket 266 will be collected. The device for actuating the collection is angle bar 254 (FIGS. 3 and 4). Thus, since the angle bar 254 is mounted on bar 248, which is in turn secured to bar 230 by pins 240 passing through slot 232, when the bar 230 is moved forwardly, the angle bar 254 is moved forwardly therewith. Assuming the plate 150 clears notch 234, thereby permitting full stroke operation, the angled edge 258 (FIG. 4) of angle bar 254 is brought into contact with dependent tab or flange 272 (FIG. 7) of coin supporting bracket 266. As viewed in FIG. 7, when this occurs, the bracket 266 is rotated in a clockwise direction around fulcrum 274. This removes the support for the deposited coins 278, and they are free to drop vertically downward between walls 156 and 212. The coins 278 then drop into the coin box 364 (FIGS. 2 and 3).

When the pressure against the plunger is released, the angle bar 254 is returned to the position shown in FIG. 3 under the urging of spring 264. At the same time, the spring returns the bar 230 to the position shown in FIG. 5, thereby readying the machine for the deposit of new money to accomplish later vending. At the same time bar 230 is returned to the position shown in FIG. 5, the plunger 22 that had been pulled will also be returned to the position shown in FIG. 5. This occurs because the pin 116 projecting from the flange of plate 94 (FIG. 6) is carried to the rear of the machine by its engagement in flange 244 of bar 230 (FIG. 5). Accordingly, the plate 94 is spring urged back to its initial position, and the movement of the plate carries plunger 22 with it by the engagement of the rear edge of plate 94 with flange 54 of the plunger (FIG. 6).

The coin box 364 is removable from bracket 358 when the front door 14 of the vending machine has been opened after lock 16 has been opened. After emptying, the coin box is replaced.

If the customer has deposited an incorrect amount of money or for some other reason desires to have his coins returned, all he need do is depress coin return lever 26 (FIG. 1). The depressing of this lever will in turn depress bar 316, which is pivotable about pin 324 (FIG. 3). As the bar 316 is depressed, it will in turn depress bar 328 by the contacting of pin 326 with the top of bar 328. As bar 328 is moved downwardly, the upper edge of opening 332 will contact pin 296 projecting from plate 288. Continued downward movement will rotate plate 288 in a counter-clockwise direction, as viewed in FIG. 7. This in turn moves screw 302 out of the path of the coins 278 on the ramp provided by bracket 266 (FIG. 3). These coins will then continue to roll down the ramp until they enter coin return chute 348 (see also FIG. 5). The coins then pass from the chute 348 to delivery chute 124, where they can be removed by the customer through opening 20 in housing 12 (FIG. 1).

At the time the coin return bar 316 is depressed, any coins in the slug rejector and coin separator 306 are also released. These coins can be coins that fail to pass through the slug rejector or coins of improper denomination that may have been retained by the slug rejector. The emptying of the slug rejector is accomplished by the linkage between opening 320 in bar 316 (FIG. 3) and the slug rejector. The linkage and the internal mechanism of the slug rejector are well known to the art, and the specific embodiment of the same forms no part of this invention. The coins emptied from the slug rejector will also pass down the coin ramp provided by bracket 266 and out through chute 348, along with the other coins that were on the ramp.

After the coins have been returned to the customer, pressure on the coin return lever 26 is released. This will in turn raise bar 328 under the urging of spring 340 (FIG. 5). This in turn will raise bar 316 by the force of bar 328 against pin 326. At the same time, the plate 288 is returned to the position shown in FIG. 7, thereby permitting the plate to again receive and hold deposited coins 278.

Referring to FIG. 5, it is seen that when bar 328 is depressed, pin 346 (see also FIG. 7) is moved into notch 234 in bar 230. Accordingly, so long as the coin return lever is depressed, no plunger 22 can be pulled, since as soon as the plunger is pulled the shoulder 236 of notch 234 will come in contact with the pin. This prevents any further movement of any of the plungers 22.

The vending machine of this invention can be used for dispensing all types of commodities, and the specific commodities form no part of the invention. By way of example, it can be used for dispensing cigarettes, candy or any commodities that can be packaged in a box, such as stockings, pantyhose, sewing kits, personal hygiene needs, etc.

It is thus seen that the vending machine of this invention provides a simple and efficient structure for vending commodities at two different prices without the necessity of providing an accumulator. Vending is accomplished solely by presence of the requisite number of coins and the contact of sensing means with these coins.

Without further elaboration, the foregoing will so fully illustrate my invention, that others may, by applying current or future knowledge, readily adapt the same for use under various conditions of service.

What is claimed as the invention is:

1. A vending machine having a plurality of merchandise columns, a manually operable member for dispensing said merchandise associated with each column, lockmeans preventing dispensing operation of all of the manually operable members until a predetermined amount of coins has been deposited in said vending machine, first sensing means responsive to a first amount of coins deposited in the vending machine and second sensing means responsive to a second amount of coins deposited in the vending machine, each of said sensing means being adapted to contact said deposited coins, a slidable bar common to all of said operable members, each of said operable members being selectively adapted to slide said bar when said operable member is pulled, said slidable bar being adapted to cause said first sensing means to contact said deposited coins, and each of said sensing means being adapted to open said lock means, whereby one of said operable members can dispense the commodity associated therewith only when a predetermined amount of coins has been deposited in said vending machine.

2. The vending machine of claim 1 wherein said first sensing means is secured on a pivotable plate, said pivotable plate being pivoted by said slidable bar when an operable member which is adapted to move said slidable bar is pulled.

3. The vending machine of claim 2 wherein said pivotable plate has a plurality of equally spaced holes formed therein, with the distance between the holes being substantially equal to the diameters of the deposited coins, with said first sensing means being adapted to be selectively inserted in one of said holes, whereby said first amount of coins can be varied in increments of one coin.

4. A vending machine having a plurality of merchandise columns, a manually operable member for dispensing said merchandise associated with each column, lock means preventing dispensing operation of all of the manually operable members until a predetermined amount of coins has been deposited in said vending machine, first sensing means responsive to a first amount of coins deposited in the vending machine and second sensing means responsive to a second amount of coins deposited in the vending machine, each of said sensing means being adapted to contact said deposited coins, ramp means for deposited coins, a wall overlying said ramp means, whereby said deposited coins will pass down said ramp means and be held in vertical alignment by said wall, means associated with said wall serving as a stop for said deposited coins on said ramp means, and each of said sensing means being adapted to open said lock means, whereby one of said operable members can dispense the commodity associated therewith only when a predetermined amount of coins has been deposited in said vending machine.

5. The vending machine of claim 4 wherein at least one of said operable members is adapted to dispense commodities at a price equivalent to said first amount of coins and the other operable members are adapted to dispense commodities priced at said second amount of coins.

6. The vending machine of claim 4 wherein each of said amounts of coins can be varied by adjustable means.

7. The vending machine of claim 4 wherein said wall has a plurality of equally spaced openings, said stop means being adapted to be selectively inserted in said openings, whereby the number of coins deposited on said ramp means can be varied.

8. The vending machine of claim 4 wherein said ramp means is resiliently held in place, said ramp means being pivotable beneath said coins whereby said ramp means can be pivoted away from said coins, thereby permitting said coins to be collected when vending takes place.

* * * * *